US005928049A

United States Patent [19]

Hudson

[11] Patent Number: 5,928,049

[45] Date of Patent: Jul. 27, 1999

[54] TOY DART

[76] Inventor: Robert H. Hudson, 103 Valley St., Seekonk, Mass. 02771

[21] Appl. No.: 08/918,415

[22] Filed: Aug. 26, 1997

[51] Int. Cl.[6] ..... A63H 33/18; A63H 33/28

[52] U.S. Cl. ..... 446/4; 446/197; 446/15; 473/578; 473/581; 473/577

[58] Field of Search ..... 446/4, 5, 6, 15, 446/176, 180, 188, 197, 213, 486; 273/FOR 329, FOR 340, 317; 124/63, 64; 473/517, 505, 516, 569, 578, 579, 580, 581, 510, 511, 577

[56] References Cited

U.S. PATENT DOCUMENTS

| | | | |
|---|---|---|---|
| 73,006 | 1/1868 | Hawkins | 473/511 |
| 1,667,123 | 4/1928 | Koller | 473/511 |
| 1,918,718 | 7/1933 | Samsel . | |
| 2,616,219 | 11/1952 | Callen . | |
| 2,710,490 | 6/1955 | Wildstein . | |
| 3,528,662 | 9/1970 | Merchant et al. . | |
| 3,903,865 | 9/1975 | Kaneko | 446/176 |
| 4,084,820 | 4/1978 | Olson, Jr. | 446/160 |
| 4,216,610 | 8/1980 | Ferris . | |
| 4,480,400 | 11/1984 | diDonato . | |
| 4,995,619 | 2/1991 | Hwang | 473/579 |
| 5,240,450 | 8/1993 | Graham | 446/267 |
| 5,538,456 | 7/1996 | Liu et al. | 446/473 |
| 5,571,037 | 11/1996 | Sellers | 446/188 |

*Primary Examiner*—Robert A. Hafer
*Assistant Examiner*—Jeffrey D. Carlson
*Attorney, Agent, or Firm*—Salter & Michaelson

[57] ABSTRACT

A toy dart includes a cylindrical wall having an inner surface, an outer surface, a first open end at one end of the cylindrical wall, and second open end at the other end of the cylindrical wall. At least two fins are attached to the outer surface of the cylindrical wall. In addition, a resilient, bulbous head portion is mounted on the cylindrical wall at the second open end thereof, the head portion defining a chamber adapted to contain fluid and having an opening formed therein so that the chamber communicates with an interior of the cylindrical wall. The toy dart is constructed and arranged for aerodynamic flight when thrown, and upon the bulbous head impacting a hard surface, the bulbous head portion deforms moving fluid contained therein into the interior of the cylindrical wall forcing an object out the cylinder. Other embodiments of the toy dart are further contemplated.

10 Claims, 11 Drawing Sheets

TOY DART

BACKGROUND OF THE INVENTION

This invention relates generally to toys and games of amusement, and more particularly to a toy dart which can be used as part of a lawn dart game or a pool dart game.

The game of lawn darts is well known to children and adults alike as a fun filled recreational game. Lawn darts, and even pool darts, involve throwing the dart a predetermined distance within a ring for example. A conventional lawn dart has an aerodynamic body typically having several fins extending outwardly therefrom, a pointed nose which is implanted in the ground after throwing the lawn dart, and a tail, coaxial with the nose, which is held while throwing the lawn dart. Beyond the challenge of accurately throwing the lawn dart through the ring, lawn darts themselves are not too amusing.

There is presently a need for a lawn dart and a pool dart which captures the attention and imagination of children and adults when played. It should be noted that projectiles capable of making noise upon landing or while thrown are well known. Reference can be made to U.S. Pat. Nos. 2,616,219 to Callen, 2,710,490 to Wildstein, 3,528,662 to Merchant et al., 4,216,610 to Ferris, 4,216,400 to diDonato, 5,240,450 to Graham, and 5,538,456 to Liu et al. as relevant prior art in this field. However, none of these references are constructed or perform in the same manner as the instant invention.

The foregoing illustrates limitations known to exist in present toy lawn dart constructions. Thus, it is apparent that it would be advantageous to provide alternative constructions which overcomes one or more of the limitations set forth above. Accordingly, suitable alternatives are provided including features more fully disclosed hereinafter.

BRIEF SUMMARY OF THE INVENTION

In general, the present invention is directed to a toy dart comprising a cylindrical wall having an inner surface, an outer surface, a first open end at one end of the cylindrical wall, and second open end at the other end of the cylindrical wall. At least two fins are attached to the outer surface of the cylindrical wall. In addition, a resilient, bulbous head portion is mounted on the cylindrical wall at the second open end thereof, the head portion defining a chamber adapted to contain fluid and having an opening formed therein so that the chamber communicates with an interior of the cylindrical wall. The toy dart is constructed and arranged for aerodynamic flight when thrown, and upon the bulbous head impacting a hard surface, the bulbous head portion deforms for moving fluid contained therein into the interior of the cylindrical wall.

More specifically, an object is disposed within the interior of the cylindrical wall, and, upon the bulbous head portion impacting a hard surface, the bulbous head portion deforms for moving the fluid into the interior of the cylindrical wall thereby forcing the object out of the cylindrical wall along an axis generally coaxial with an axis of the cylindrical wall. Preferably, the second open end has a diameter less than the diameter of the first open end. The object has a circular body shape with a diameter slightly more than the tapered diameter of the second open end so that the object is captured within the cylindrical wall prior to the object being expelled therefrom when the toy dart impacts the hard surface.

In a second aspect of the present invention, soapy fluid can be deposited within the chamber of the head portion. In this embodiment, the toy dart has a plate with a plurality of openings formed therein with the plate being attached to the cylindrical wall at its first open end. The arrangement is such that upon the head portion impacting a hard surface, the head portion deforms for moving the soapy fluid contained in the chamber thereof into the interior of the cylindrical wall and out of the plate, the fluid passing through the plate for forming bubbles.

In a third aspect of the present invention, the toy dart comprises a cylindrical wall having an inner surface defining a chamber, an outer surface, a first open end at one end of the cylindrical wall, and second open end at the other end of the cylindrical wall. In this embodiment, there is provided a sliding member having a piston slidably movable within the chamber of the cylindrical wall between a first position in which the piston is adjacent the second open end of the cylindrical wall and a second position in which the piston is adjacent the first open end of the cylindrical wall. A shaft is fixedly attached to the piston at one end thereof, the shaft extending through the second open end of the cylindrical wall. An impact head is fixedly attached to the shaft at the other end of the shaft with the impact head being located outside the chamber of the cylindrical wall. A cap is releasably attached to the cylindrical wall so as to cover the first open end thereof. The arrangement is such that upon the impact head impacting a hard surface, the piston slides to its second position and compresses the air for forcing the cap off of the cylindrical wall thereby creating a loud noise.

Accordingly, among the several objects of the present invention are: the provision of a toy dart which is capable of being used during lawn and pool dart games; the provision of such a toy dart which is capable of projecting fluid (e.g., water, soapy water, etc.) or an object from its tail end upon impacting a surface; the provision of such a toy dart which is capable of making loud noises; the provision of such a toy dart which is fun and easy to use by children and adults alike; and the provision of such a toy dart which is simple in construction, cost-efficient to manufacture, economical to purchase, and safe to use.

Other objects, features arid advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
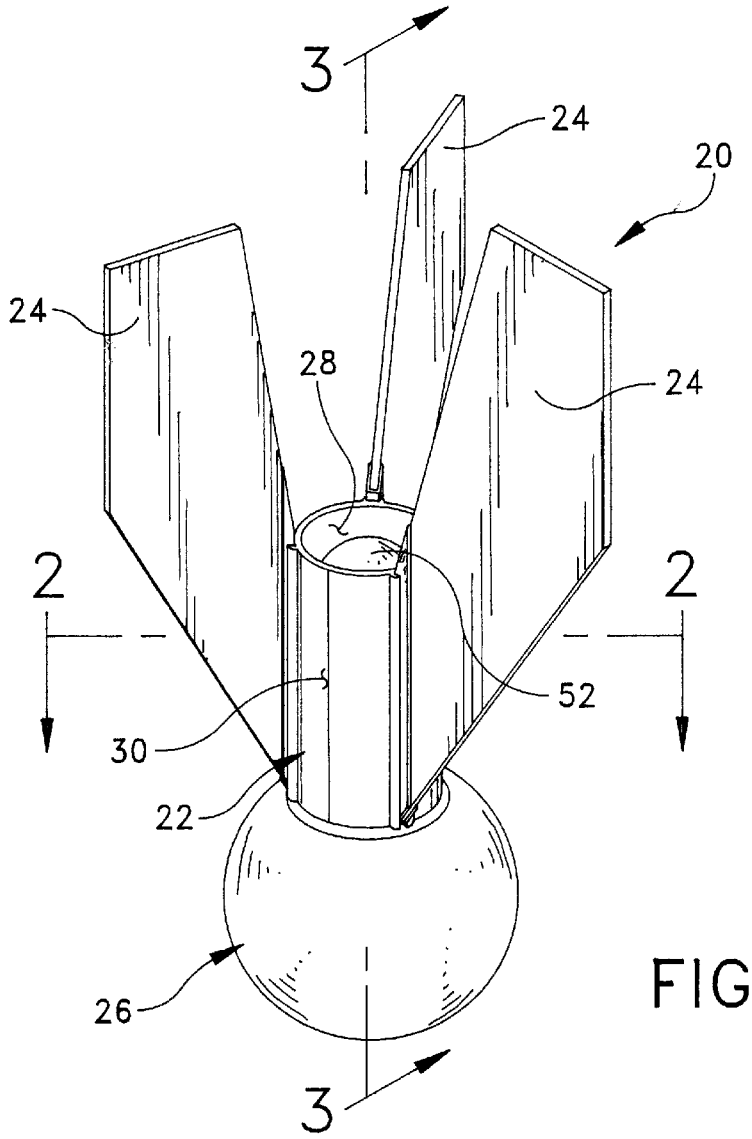
FIG. 1 is a perspective view of a toy dart of the present invention.

Referring now to the drawings, and initially to FIGS. 1–4, there is generally indicated at 20 a toy dart of a first embodiment of the present invention. As shown, the toy dart 20 comprises three major components, they are: a cylindrical wall, generally indicated at 22; three fins, each indicated at 24, which are attached to the cylindrical wall; and a resilient, bulbous head portion, generally indicated at 26. The toy dart 20 of this embodiment (and the other embodiments to be described in greater detail below) is constructed for aerodynamic flight when thrown. Stated another way, the toy dart 20, after it is thrown, moves through the air with the head portion 26 leading the way and the tail ends of the fins 24 trailing behind. This results in the head portion 26 of the toy dart first impacting the ground when its flight is completed.

Figure 2:
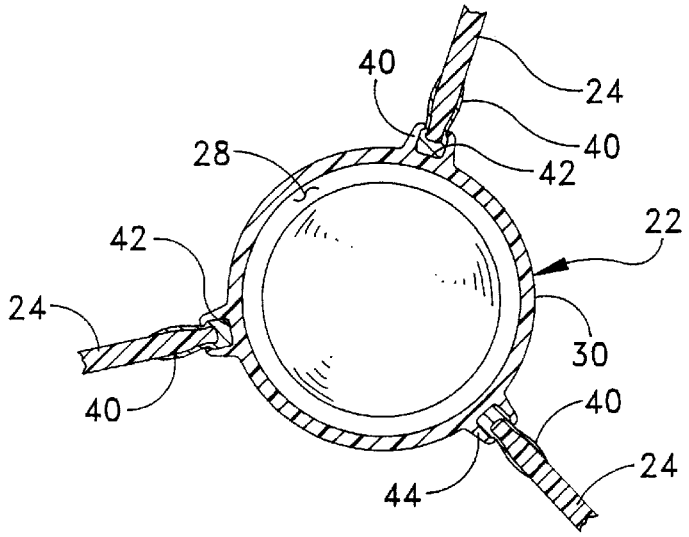
FIG. 2 is a cross-sectional view of the toy dart taken along line 2—2 of FIG. 1.
Figure 3:
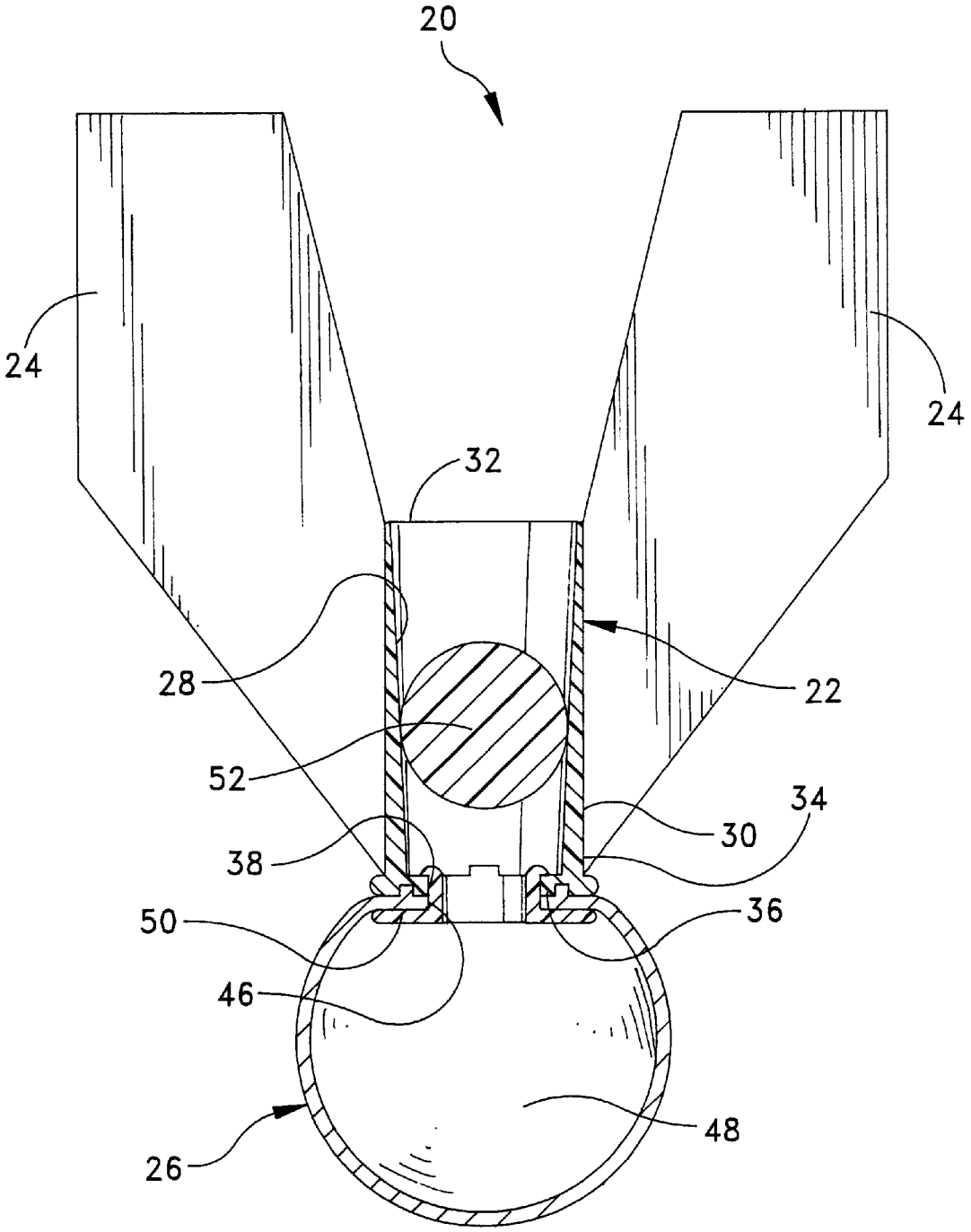
FIG. 3 is a cross-sectional view of the toy dart taken along line 3—3 of FIG. 1.

Referring to FIGS. 2 and 3, the cylindrical wall 22 has an inner surface 28, an outer surface 30, a first (upper) open end 32 at one end of the cylindrical wall, and a second (lower) open end 34 at the other end of the cylindrical wall. As shown, the cylindrical wall 22 has a slightly tapered inside diameter so that the second open end 34 has a diameter slightly less than the diameter of the first open end 32. The purpose of this taper on the inner surface 28 of the cylindrical wall 22 will become apparent as the description of the toy dart 20 proceeds. The second open end 34 is formed with an inwardly projecting lip 36 which defines an opening 38 which communicates with the interior of the head portion 26. Preferably, the cylindrical wall 22 is fabricated from any suitable thermoplastic material which is rigid in construction.

As illustrated in FIG. 2, the fins 24 are separate from the cylindrical wall 22; however, it should be understood that the fins can be integrally formed with the wall and still fall within the scope of the present invention. Moreover, any number of fins 24 suitable for the toy dart achieving aerodynamic flight can be utilized as well. In the shown embodiment, each fin 24 is attached to the outer surface 30 of the cylindrical wall 22 by a U-shaped retaining clip 40 which is secured along a long edge of the fin. The retaining clip 40, in turn, is received in a channel 42 created by a formation 44 formed on the outer surface 30 of the cylindrical wall 22. Specifically, the retaining clips 40 are glued onto their respective fins 24, it being noted that the major surfaces of the retaining clips extend over their respective fins approximately ½ inch. These clips 40 enable the fins 24 to be easily removed from the cylindrical wall 22 for replacement, if required. The fins 24 are preferably fabricated from foamed thermoplastic material, whereas the clips 40 are made from semi-rigid thermoplastic material. Since the toy dart 20 is not provided with a handle for throwing, one of the fins 24 is held when throwing the toy dart. This can place undue wear and tear on the fins 24, particularly at the junction of the fin to the cylindrical wall 22 at the tail end of the toy dart 22. Thus, this construction enables the fins 24 to be easily replaced.

Turning back to FIG. 3, the bulbous head portion 26 is generally spherical in shape and has an opening 46 formed therein which generally corresponds to the second open end 34 of the cylindrical wall 22. The head portion 26 defines a chamber 48 which is adapted to contain fluid (liquid or gas), and is releasably secured to the cylindrical wall 22 at the second open end 34 thereof by an annular retaining member 50. The retaining member 50 captures the edge margin surrounding the opening 46 of the head portion 26 and is snap fit onto the lip 36 of the cylindrical wall 22 for securely retaining the head portion thereto. The provision of a retaining member 50 is for ease of manufacturing, it being understood that any suitable method of securing the head portion 26 to the cylindrical wall 22 is acceptable.

Figure 4:
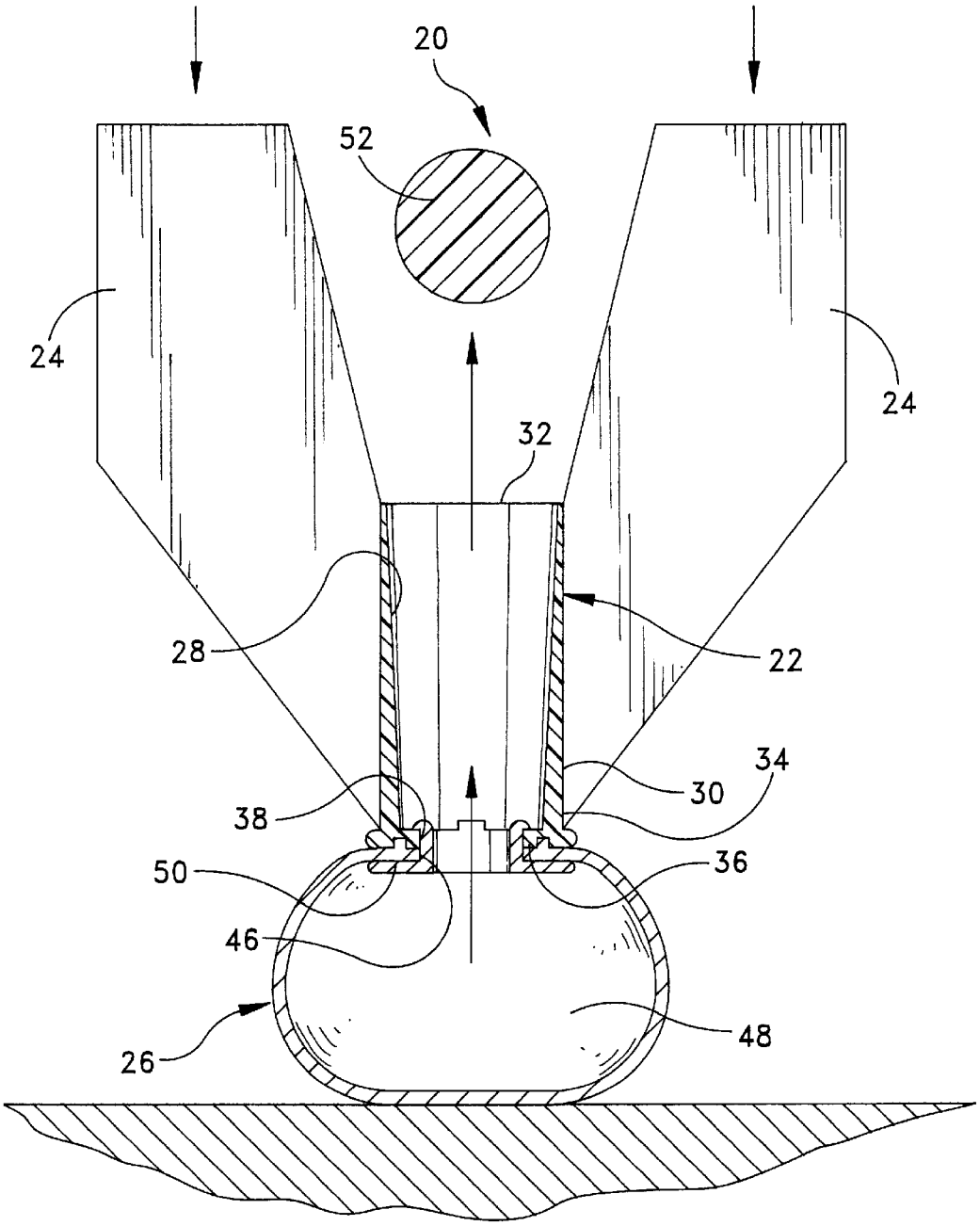
FIG. 4 is a cross-sectional view similar to FIG. 2 illustrating the toy dart as it impacts a hard surface.

Referring now to FIGS. 3 and 4, the head portion 26, as stated above, is resilient in nature and capable of being resiliently deformed. In this regard, it can be fabricated from rubber or synthetic rubber material (e.g., resilient vinyl). As illustrated in FIG. 4, when the head portion 26 of the toy dart 20 impacts a hard surface, e.g., the ground, it resiliently deforms to expel fluid, e.g., air, out of its chamber 48 into the interior region of the cylindrical wall 22. In the embodiment illustrated in FIGS. 1–4, an object 52 (a ball) having a spherical body is placed within the interior region of the cylindrical wall 22. This object 52 has a diameter slightly more than the minimum tapered diameter of the second open end 34 so that it is somewhat captured within the interior region of the cylindrical wall 22 and engages the inner surface 28 prior to the toy dart 20 being thrown. Preferably, the object 52 is fabricated from foamed thermoplastic material or vinyl.

The impact of the head portion 26 against the hard surface expels the air out of the chamber 48 of the head portion into the interior region of the cylindrical wall 22 thereby causing the object 52 to eject out of the cylindrical wall along an axis generally coaxial with the axis of the cylindrical wall. This feature adds excitement to the game when the toy dart 20 is thrown. Specifically, one game that can be played, in addition to attempting to throw the toy dart 20 through a ring, can be to catch the object 52 after the toy dart lands, thereby earning the player extra points if the object is caught. It should be noted that the cylindrical wall 22 of the toy dart 20 can be elongated so as to accommodate two objects instead of one. Also, objects of varying shapes and sizes can be used in place of spherical object 52 so long as they fit properly within the cylinder wall 28.

The toy dart can also be constructed with whistling devices (not shown) provided on the fins 24 or on the cylindrical wall 22. The whistling devices whistle when traveling through air. Moreover, metal weights (also not shown) can be provided at the front end of the toy dart 20 in order to enable it to fly better.

Turning now to FIGS. 5–8, there is generally indicated at 54 a toy dart of another preferred embodiment. More specifically, toy dart 54 is constructed similarly to toy dart 20 in that it comprises a cylindrical wall, generally indicated at 56, a plurality of fins, each indicated at 58, and a head portion, generally indicated at 60. The difference between toy dart 54 and toy dart 20 is that instead of projecting object 52, the toy dart 54 is capable of generating a stream of bubbles during flight and bubbles after it lands (see FIG. 8).

Figure 6:
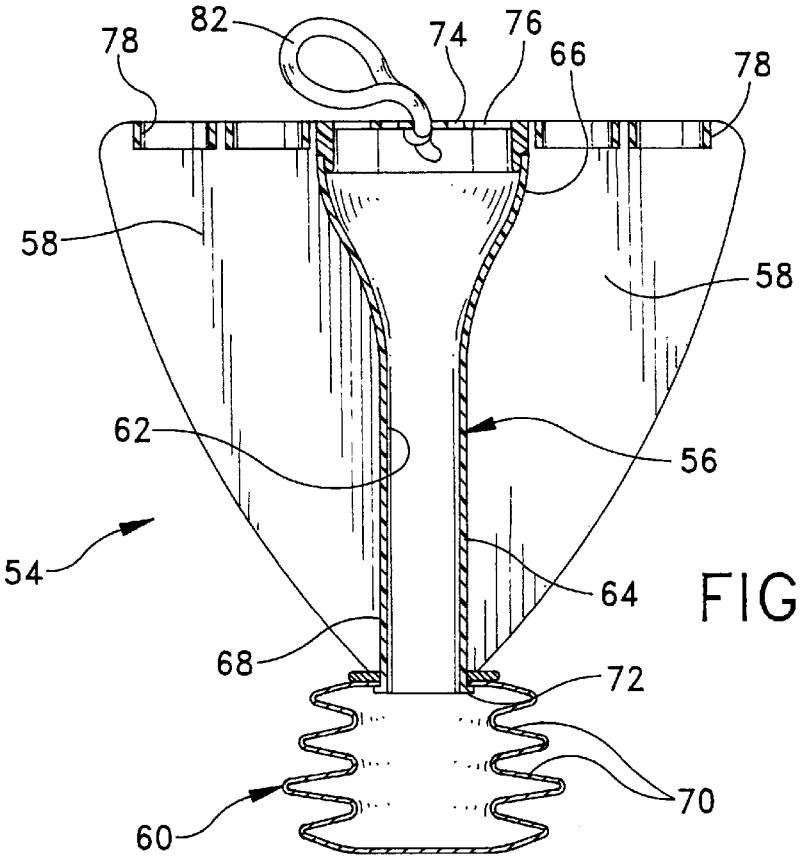
FIG. 6 is a cross-sectional view of the toy dart illustrated in FIG. 5 taken along line 6—6 thereof.
Figure 7:
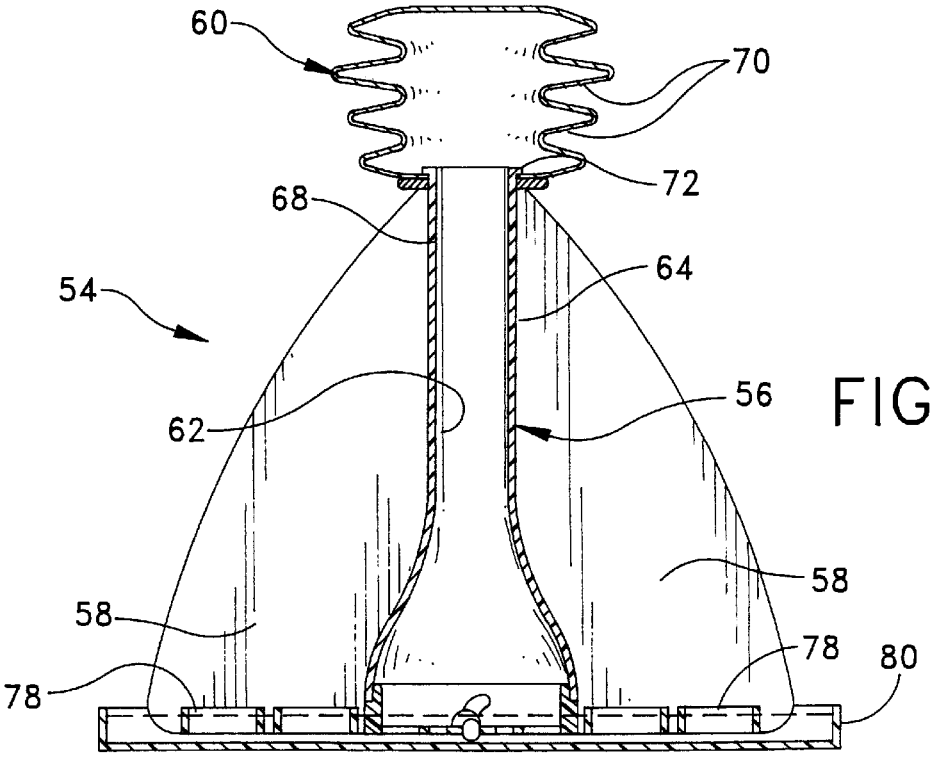
FIG. 7 is an inverted cross-sectional view similar to FIG. 6 illustrating a tail end of the toy dart immersed in a container having soapy fluid.

As shown, the cylindrical wall 56 of the toy dart 54 has an inner surface 62, an outer surface 64, a first open end 66 and a second open end 68. The first open end 66 is generally funnel-shaped until it reaches the approximate midpoint of the cylindrical wall 56. From there, the diameter of the cylindrical wall 56 is constant to the second open end 68. Also, the fins 58 can be integrally formed with the cylindrical wall 56 as illustrated in FIGS. 6 and 7.

In this embodiment, the head portion 60 is still fabricated from resilient material, but, instead of being spherical in shape, it is of bellows-like construction in that it has a plurality of pleated folds 70 formed therein which contract upon impacting a hard surface. Preferably, the head portion 60 is snap fit onto the second open end 68 of the cylindrical wall 56, the wall being provided with a circumferential flange 72 which retains the head portion thereto. The head portion 60 can be filled with soapy fluid, for example, by pouring such fluid through the first open end 66 of the cylindrical wall 56. The purpose of providing soapy fluid in the head portion 60 will become apparent below.

A plate 74 having a plurality of openings 76 formed therein is further provided at the first open end 66 of the cylindrical wall 56. This plate 74 can be attached to the cylindrical wall 56 in any suitable manner, or it can be formed integrally therewith as one piece. The size of the openings 76 can vary for creating relatively large and small bubbles. The arrangement is such that when the head portion 60 of the toy dart 54 impacts a hard surface, the head portion deforms and contracts along the pleated folds 70 for moving the soapy fluid contained in the chamber of the head portion 60 into the interior of the cylindrical wall 56 and out of the plate 74. When the soapy fluid passes through the plate 74, bubbles are formed in the manner shown in FIG. 8. This feature also adds excitement to the game when the toy dart 54 is thrown.

Figure 8:
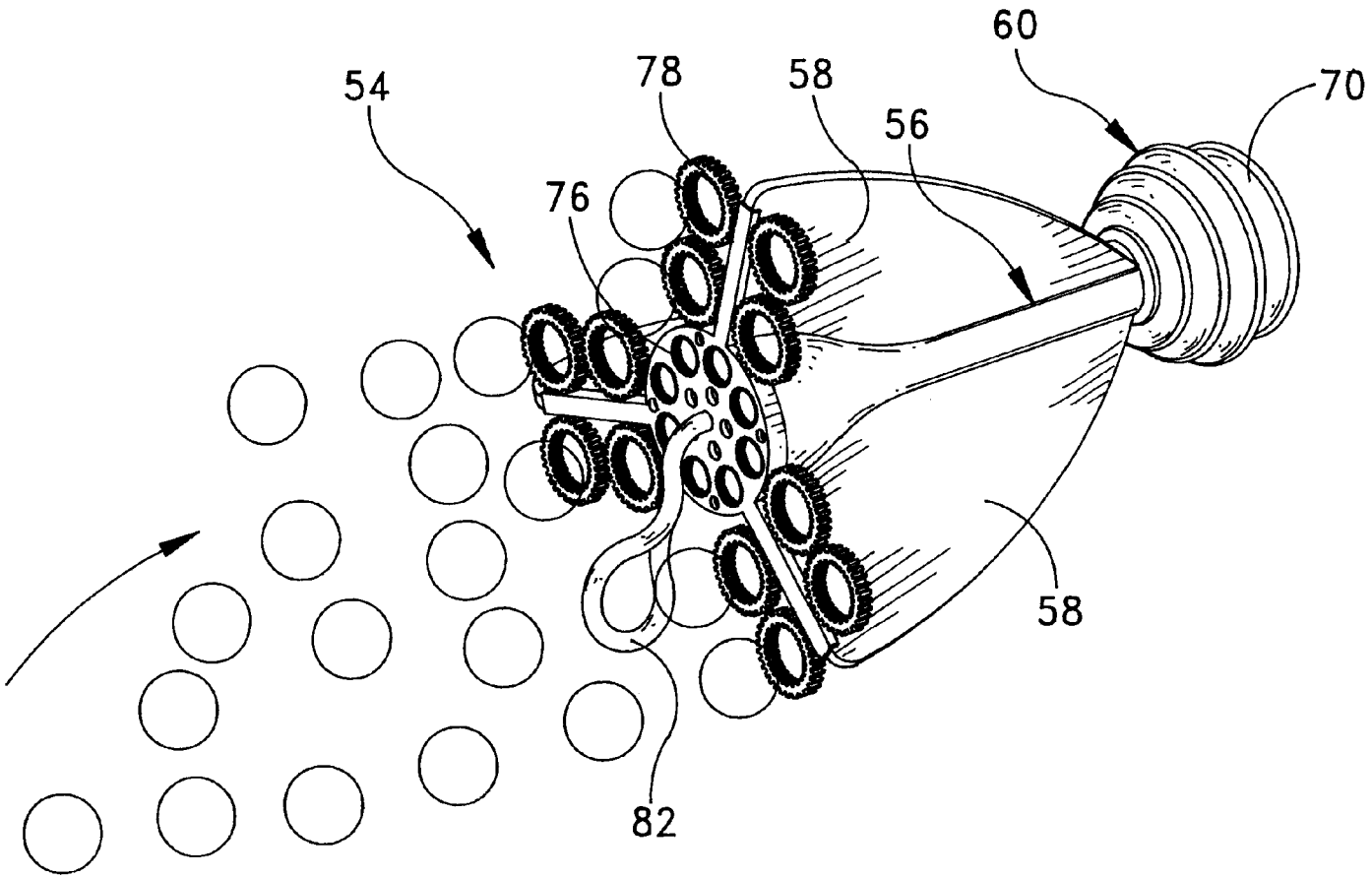
FIG. 8 is a perspective view of the toy dart illustrated in FIGS. 5–7 illustrating the toy dart after it is thrown.

The toy dart 54 further includes a plurality of rings each indicated at 78 as radiating members of plate 74 and fixedly attached to the tail ends of the fins 58. As shown, each fin 58 has four rings 78 formed on its tail end; however, any number of rings can be provided. Referring to FIG. 7, prior to throwing the toy dart. 54, these rings 78 can be submerged in soapy fluid contained in a shallow container 80. Then, upon throwing the toy dart 54, bubbles are formed from these rings 78 as a result of the air passing through the rings. This is also illustrated in FIG. 8. The rings 78 can be attached to the fins 58 in any well known manner. A tether 82 having a looped end is fixedly attached at one end thereof to the plate 74 for enabling a player to easily throw the toy dart 54 of this embodiment.

Figure 5:
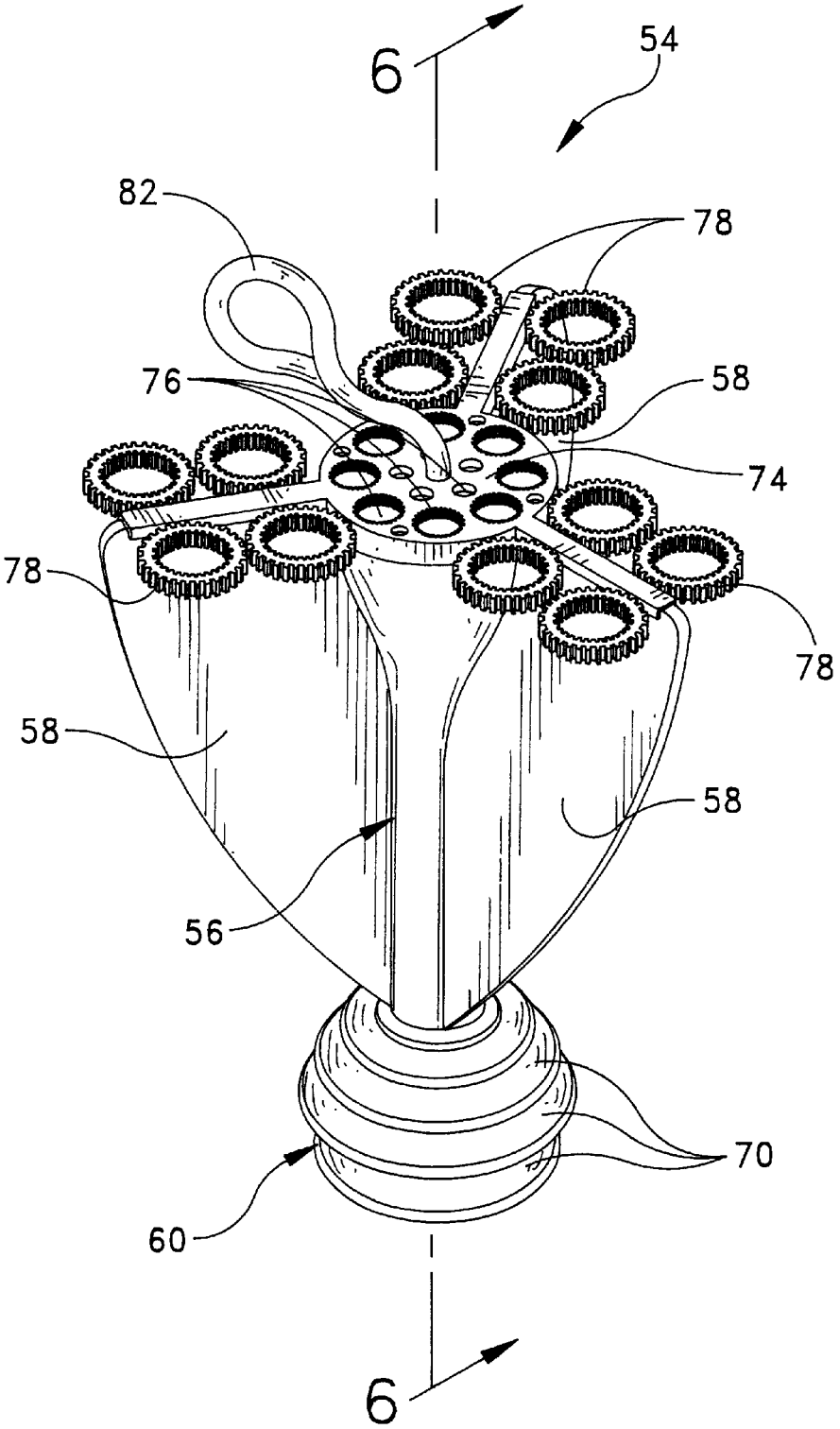
FIGS. 5 and 5A are perspective views of a toy dart of another preferred embodiment.
Figure 5A:
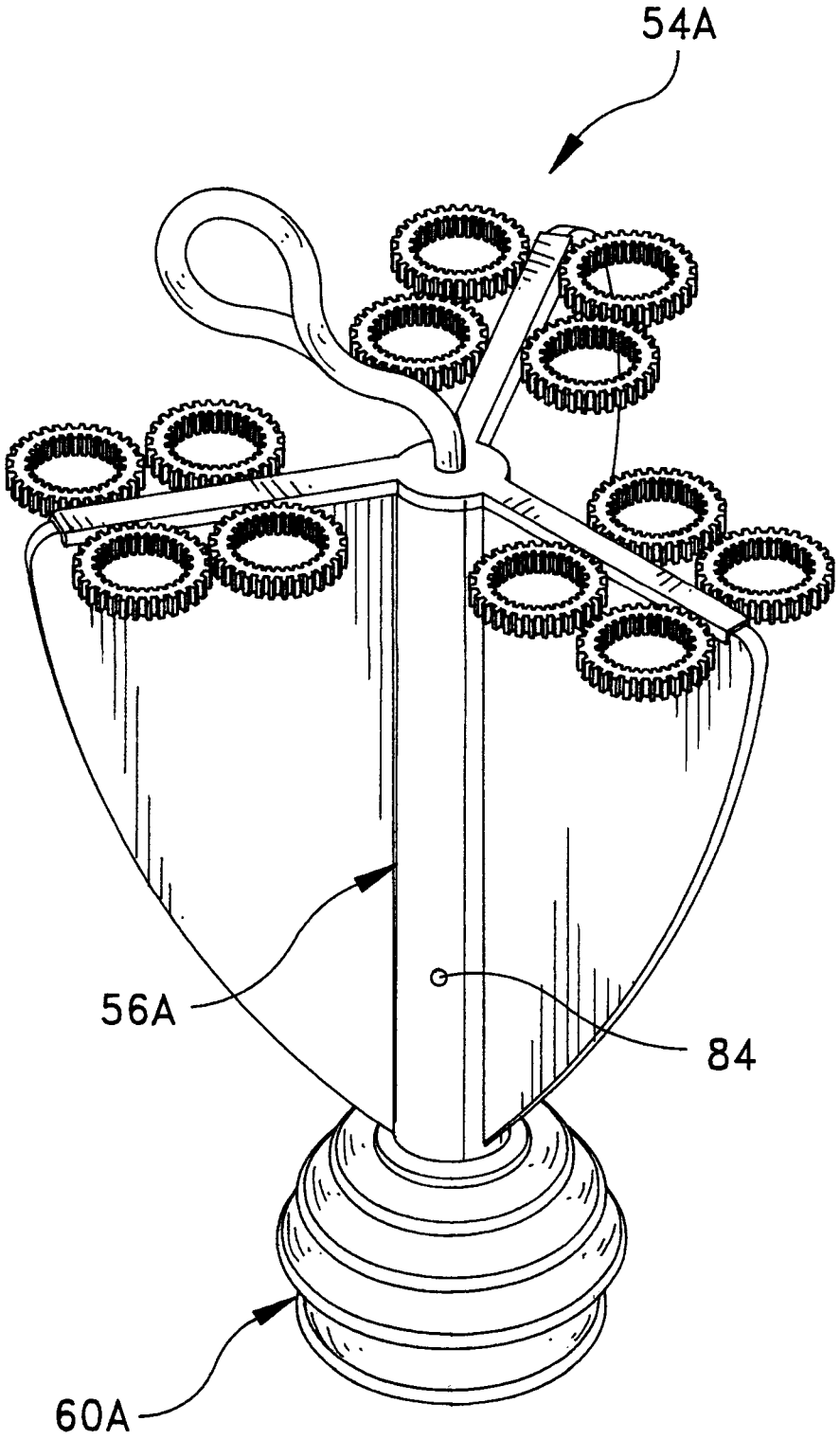

FIG. 5A illustrates a toy dart 54A substantially similar to toy dart 54, except it lacks the plate 74. As shown, the cylindrical wall 56A is not tapered and includes an opening 84 for allowing air to be expelled in order to reduce bouncing when its bulbous head portion 60A impacts the ground.

Figure 9:
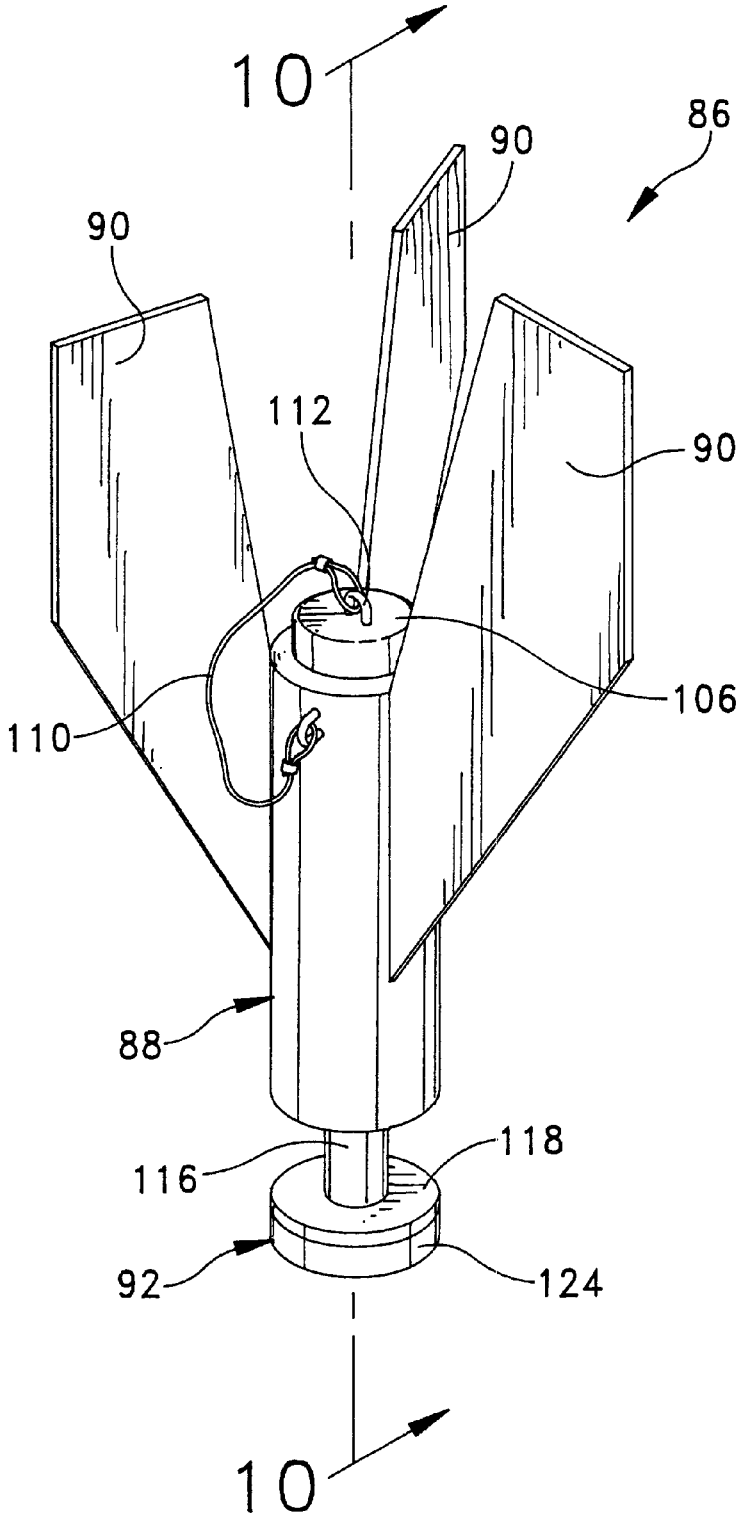
FIG. 9 is a perspective view of a toy dart of yet another preferred embodiment.
Figure 10:
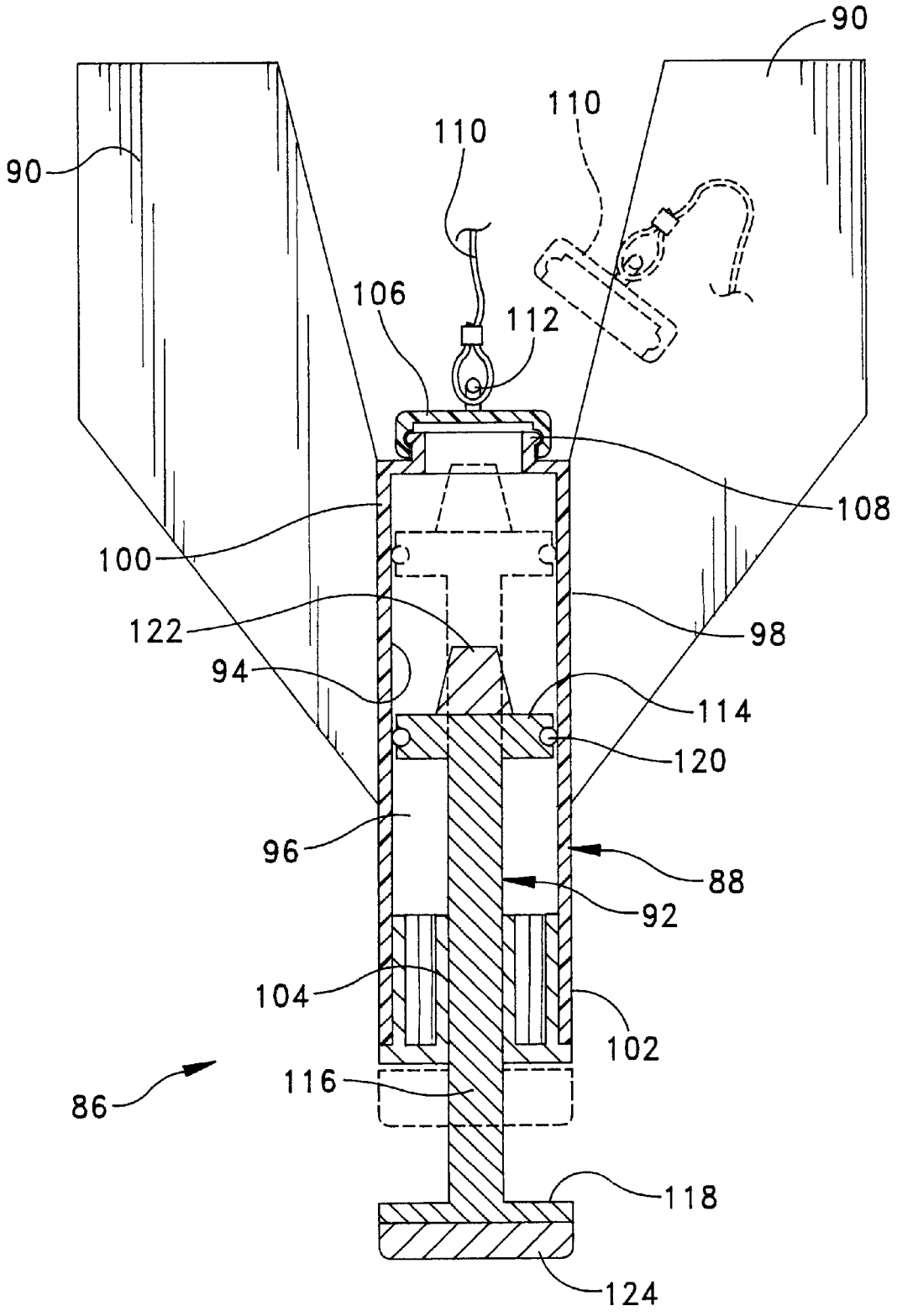
FIG. 10 is a cross-sectional view of the toy dart illustrated in FIG. 9 taken along line 10—10 thereof.

Turning now to FIGS. 9 and 10, there is generally indicated at 86 a toy dart of yet another preferred embodiment. As shown, this toy dart 86 also comprises three major components which are a cylindrical wall, generally indicated at 88, three fins, each indicated at 90, which are attached to the outer surface of the cylindrical wall, and a sliding member, generally indicated at 92. This toy dart 86 is especially suited for whistling when thrown and for making a loud, explosive (bomb-like) noise upon landing on a hard surface.

The cylindrical wall 88 has an inner surface 94 defining a chamber 96, an outer surface 98, a first (upper) open end 100 at one end of the cylindrical wall, and a second (lower) open end 102 at the other end of the cylindrical wall. As shown, the cylindrical wall 88 has a constant diameter along its length. The second open end 102 is formed with an inwardly projecting formation 104 which defines a sliding member guide which receives the sliding member 92.

Still referring to FIGS. 9 and 10, a cap 106 is releasably attached to the cylindrical wall 88 so as to cover the first open end 100 thereof. This cap 106 is of standard construction and is designed to snap fit over an annular lip 108 formed on the cylindrical wall in the manner illustrated in FIG. 10. A tether 110 is provided for ensuring the cap 106 remains with the toy dart 86 so that it is not inadvertently lost. As shown, the tether 110 has one of its ends secured through a loop 112 formed on the outer surface of the cap 106 and its other end fixedly attached by any suitable means to the cylindrical wall, for example.

When there is increased air pressure within the chamber 96 of the cylindrical wall 88, the cap 106 "pops" off the end of the cylindrical wall, thereby creating a loud, bomb-like noise. Any type of means for increasing the air pressure within the chamber 96 can be provided. For example, a bellows-like head portion (not shown) can be mounted on the forward end of the cylindrical wall 88 for creating the required increase of air pressure within the chamber 96 in order to pop the cap 106 off the cylindrical wall. For economy purposes, this embodiment is not illustrated in FIGS. 9 and 10, but would substantially resemble the bellows-like head portion 60 illustrated in FIGS. 5–8.

In the shown embodiment, the sliding member 92 includes a piston 114, a shaft 116 fixedly attached to the piston 114, and an impact head 118 fixedly attached to the shaft. More specifically, the piston 114 is slidably movable within the chamber 96 of the cylindrical wall 88 between a first position (illustrated by solid lines in FIG. 10) in which the piston is adjacent the second open end 102, and a second position (illustrated by broken lines in FIG. 10) in which the piston is adjacent the first open end 100. A seal 120 (e.g., an o-ring) is provided around the circumferential edge of the piston 114 for blocking communication between chambers created above and below the piston. Furthermore, a resilient, open cell, foam protrusion 122 is fixedly attached to the upper surface of the piston 114 as illustrated in FIG. 10, the protrusion extending through the first open end 100 of the cylindrical wall 88 when the piston is in its second position.

The shaft 116 is fixedly attached to or formed integrally with the piston 114 at one end thereof, and extends through the guide 104 of the second open end 102 of the cylindrical wall 88. The impact head 118 is also fixedly attached to or formed integrally with the other end of the shaft 116 wherein it is located outside the chamber 96 of the cylindrical wall 88. As shown, a cushion or pad 124 can be applied (as by adhesive) to the exposed surface of the impact head 118 for cushioning the impact of the impact head against surfaces where scratching or marking is undesired.

The arrangement is such that upon the impact head 118 impacting a hard surface, the piston 114 of the slide member 92 slides to its second position whereby the increased air pressure forces the cap 106 off the cylindrical wall 88. This forcing action creates a loud noise or "pop" which is particularly desired by young people.

In order to create the illusion of smoke during the flight and landing of the toy dart 86, powdered material, such as corn starch, can be deposited inside the chamber 96 and on the foam protrusion 122 for creating this illusion. The foam protrusion, with the powder adhering to it, is in the air blast when the cap blows off; and the powder, consequently, goes with the air. Additionally, whistles (not shown) can further be provided on the fins 90, for example, of the toy dart 86 for creating a whistling noise during flight. Thus, the toy dart 86, when provided with corn starch and whistles, and when combined with the cap 106 popping off after it impacts a hard surface, creates the appearance of a miniature rocket or bomb.

Figure 11:
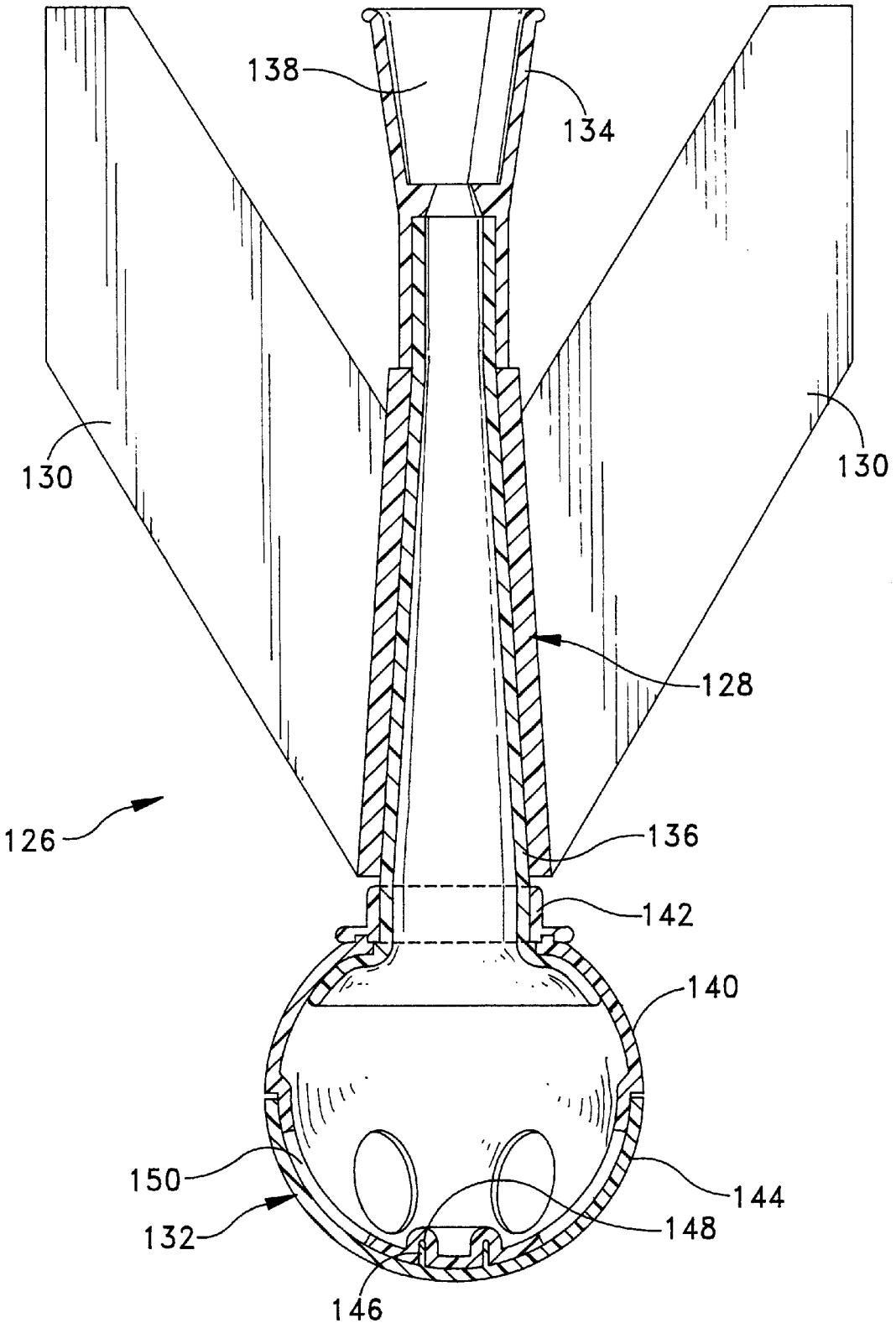
FIG. 11 is a cross-sectional view of a toy dart of a further preferred embodiment.

Referring now to FIG. 11, there is generally indicated at 126 another embodiment of the toy dart which is specifically directed to shooting fluid (e.g., water) radially and vertically therefrom. This toy dart 126 is substantially similar to the toy dart 20 illustrated in FIGS. 1–4 in that it has a cylindrical wall, generally indicated at 128, a plurality of fins, each indicated at 130, and a bulbous head portion, generally indicated at 132. In this embodiment, the cylindrical wall 128 is generally hourglass-shaped, tapering inwardly from its first and second open ends 134, 136, respectively, to the middle thereof. The tail end portion of the cylindrical wall 128 defines a nozzle 138 through which water is expelled in the manner to be described below.

The head portion 132 includes two separate pieces—a bulbous inner piece 140 which is connected to the second open end 136 of the cylindrical wall 128 by a retaining member 142 and an outer piece 144 which is connected to the inner piece by a circular rib 146. Specifically, the inner piece 140 has a corresponding recess 148 which receives the circular rib 146 for attaching the outer piece 144 thereto. The inner piece 140 has a plurality of holes 150 formed therein through which water can be added by folding back the outer piece 144. Water can also be added through the first open end 134 of the cylindrical wall 128. The outer piece 144 forms a seal around the perimeter of the inner piece 140 for maintaining water inside until impact at which time the increased water pressure within the head portion 132 overcomes this sealing force and the water escapes through the openings in a radially directed, conical pattern.

When the toy dart 126 is thrown by swinging by the nozzle 138 of the toy dart, centrifugal force keeps water from spilling out of the nozzle. After the toy dart 126 is released, air resistance acting against the head portion 132 causes a decelerating drag. This drag keeps a small negative gravity load on the water contained therein which causes it to remain in the head portion 132 of the toy dart 126. Additionally, while the head portion 132 of the toy dart 126 is being deformed from the impacting force, the tail section thereof (i.e., the cylindrical wall 128 and fins 130) is continuing its downward movement onto the water remaining inside the head portion. This remaining water is propelled upwardly through the cylindrical wall 128. Thus, water is forcibly ejected vertically from the nozzle 138 and radially outwardly from the head portion 132, thereby displaying in a fun environment the forces of physics and nature.

Figure 12:
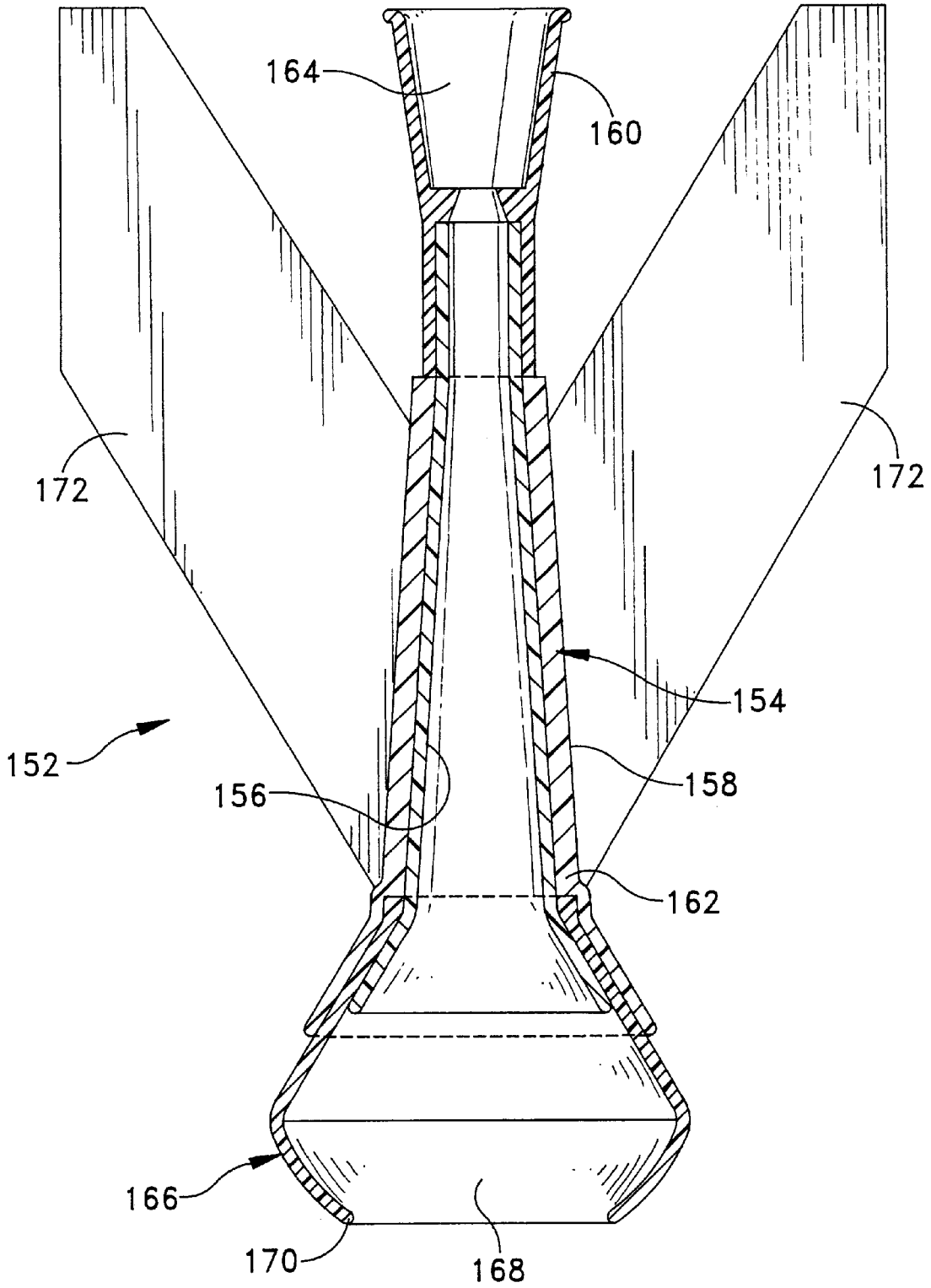
FIG. 12 is a cross-sectional view of a toy dart of another preferred embodiment constructed specifically for use in a pool.

Lastly, there is generally indicated at 152 in FIG. 12 a toy dart of another preferred embodiment. This toy dart 152 is especially suited for use in a pool whereby players can attempt to throw the toy dart in floating rings provided in the pool. However, in addition, the toy dart 152 can also expel water out of its tail end. Thus, players can attempt to see who can obtain the highest water stream as well as throw the toy dart 152 in the floating ring.

The toy dart comprises a cylindrical wall generally indicated at 154, having an inner surface 156, an outer surface 158, a first open end 160 at one end of the cylindrical wall, and a second open end 162 at the other end of the cylindrical wall. As with toy dart 126, the cylindrical wall 154 of toy dart 152 is generally hourglass-shaped, tapering inwardly from its first and second open ends 160, 162 to the middle thereof. The tail end of the cylindrical wall 154 also defines a nozzle 164. In place of a bulbous head portion, a resilient nose cone generally indicated at 166, is mounted on the cylindrical wall 154 at the second open end 162 thereof. The nose cone 166 defines a channel 168 adapted to receive fluid therein when the toy dart 152 impacts a fluid surface. More specifically, the nose cone 166 has an outer end 170 that tapers inwardly, the outer end folding back into the remainder of the nose cone upon impacting the fluid. The nose cone 166, or cylindrical wall 154 adjacent the nose cone, can be weighted for ensuring that the toy dart 152 does not straddle the ring, but lands either inside or outside the ring. Foamed thermoplastic fins 172 enable the toy dart to float in the water.

Upon impact, the aerodynamic front of the nose cone 166 folds back inside itself which provides a conical shape for the water to enter. As the volume of water continues into the nose cone 166, the decreasing diameter of the nose cone maintains conservation of momentum by increasing the velocity of the water, thereby squirting the water out of the first open end 160 of the cylindrical wall 154 at a rather high velocity. The arrangement is such that the higher the toy dart 152 is thrown, the higher the water stream travels.

It can therefore be seen that for these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A toy dart comprising:

a cylindrical wall having an inner surface, an outer surface, a first open end at one end of the cylindrical wall, and second open end at the other end of the cylindrical wall;

at least two fins attached to the outer surface of the cylindrical wall;

an object disposed within the interior of the cylindrical wall; and a resilient, bulbous head portion mounted on the cylindrical wall at the second open end thereof, said head portion defining a chamber adapted to contain fluid and having an opening formed therein so that the chamber communicates with an interior of the cylindrical wall, the toy dart being constructed and arranged for aerodynamic flight when thrown, and upon the bulbous head impacting a hard surface, the bulbous head portion deforms for moving fluid contained therein into the interior of the cylindrical wall thereby forcing the object out of the cylindrical wall along an axis generally coaxial with an axis of the cylindrical wall.

2. A toy dart as set forth in claim 1, the second open end having a diameter less than the diameter of the first open end thereby defining a tapered inner surface.

3. A toy dart as set forth in claim 2, the object having a body with a diameter slightly more than the tapered diameter of the second open end.

4. A toy dart as set forth in claim 1, wherein the fluid is a liquid.

5. A toy dart as set forth in claim 1, wherein the fluid is a gas.

6. A toy dart comprising:

a cylindrical wall having an inner surface, an outer surface, a first open end at one end of the wall, and second open end at the other end of the wall;

at least two fins attached to the outer surface of the cylindrical wall;

a resilient, bulbous head portion mounted on the cylindrical wall at the second open end thereof, said head portion having an opening formed therein so that a chamber defined by the head portion communicates with an interior of the cylindrical wall; and an object disposed within the interior of the cylindrical wall so that upon the bulbous head impacting a surface, the bulbous head portion deforms for moving fluid into the interior of the cylindrical wall thereby forcing the object out of the cylindrical wall.

7. A toy dart comprising:

a cylindrical wall having an inner surface, an outer surface, a first open end at one end of the wall, and second open end at the other end of the wall, the second open end having a diameter less than the diameter of the first open end;

at least two fins attached to the outer surface of the cylindrical wall;

a resilient, bulbous head portion mounted on the cylindrical wall at the second open end thereof, said head portion having an opening formed therein so that a chamber defined by the head portion communicates with an interior of the cylindrical wall; and an object disposed within the interior of the cylindrical wall so that upon the bulbous head impacting a hard surface, the bulbous head portion deforms for moving fluid into the interior of the cylindrical wall thereby forcing the object out of the cylindrical wall.

8. A toy dart as set forth in claim 7 wherein the fluid is a liquid.

9. A toy dart as set forth in claim 7 wherein the fluid is a gas.

10. A toy dart as set forth in claim 7, the object having a body with a diameter slightly more than the diameter of the second open end.

* * * * *